United States Patent [19]

Panicci

[11] 3,960,289

[45] June 1, 1976

[54] LATCHING RECEPTACLE LID

[75] Inventor: Richard L. Panicci, Hanover, Mass.

[73] Assignee: Kiddie Products, Inc., Avon, Mass.

[22] Filed: Apr. 9, 1975

[21] Appl. No.: 566,179

[52] U.S. Cl. ..... 220/318; 220/87; 220/96; 220/322

[51] Int. Cl.[2] ..... B65D 25/28; B65D 45/00

[58] Field of Search ..... 220/306, 255, 318, 322, 220/317, 301, 306, 96, 87; 292/241

[56] References Cited

UNITED STATES PATENTS

| | | | |
|---|---|---|---|
| 154,272 | 8/1874 | Neale et al. | 220/317 |
| 243,803 | 7/1881 | Scoville | 220/318 |
| 945,927 | 1/1910 | Forster | 220/301 |
| 1,559,594 | 11/1925 | Wentorf et al. | 220/318 |
| 2,081,925 | 6/1937 | Graf | 220/318 |
| 2,123,126 | 7/1938 | Urech | 220/318 |
| 2,178,868 | 11/1939 | Bullock | 220/318 |
| 2,586,005 | 2/1952 | Colonna | 292/241 |
| 2,985,335 | 5/1961 | Bliss | 220/318 |
| 3,416,701 | 12/1968 | Kramer et al. | 220/318 |

FOREIGN PATENTS OR APPLICATIONS

| | | | |
|---|---|---|---|
| 458,371 | 11/1926 | Germany | 292/241 |

*Primary Examiner*—George E. Lowrance
*Assistant Examiner*—Allan N. Shoap

[57] ABSTRACT

A pail having a circular lid with a latching surface extending continuously about the periphery thereof, resilient latch members on opposite sides of said pail having latch portions to engage said latching surface, a bail having its ends adjacent said latch members, cam surfaces on said bail and cam followers on said latch members for moving said latch portions toward and away from a position engaging said latching surface, said cam surfaces and cam followers positioned to lock said lid on said pail with said bail on one side and over said pail and to unlock said lid with said bail on the other side of said pail.

23 Claims, 17 Drawing Figures

FIG 11
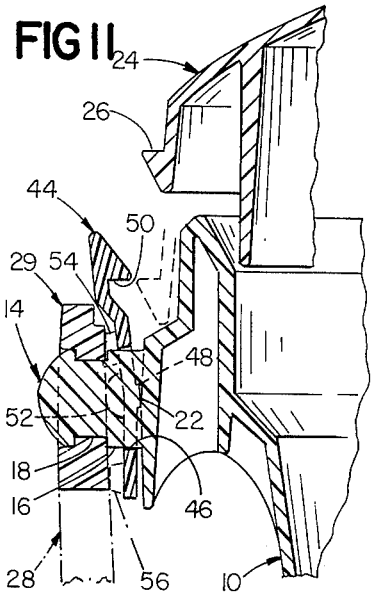
FIG 12
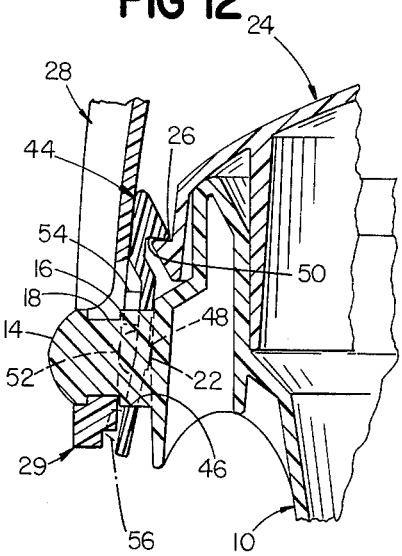
FIG 13
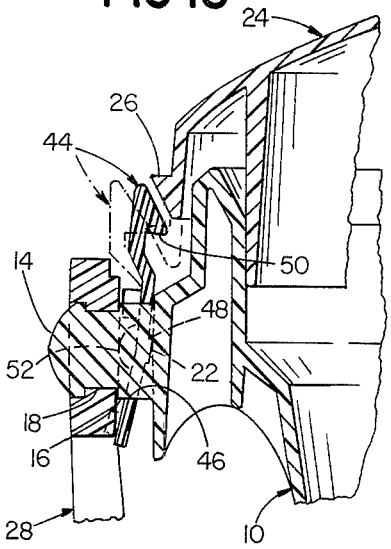
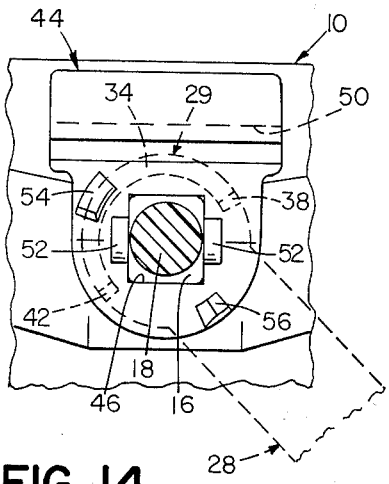
FIG 14
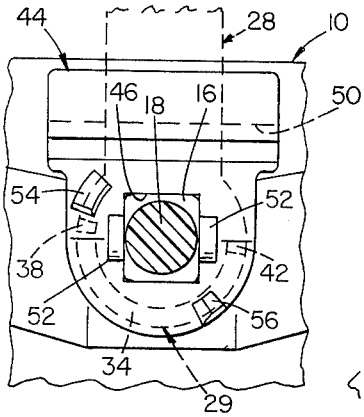
FIG 15
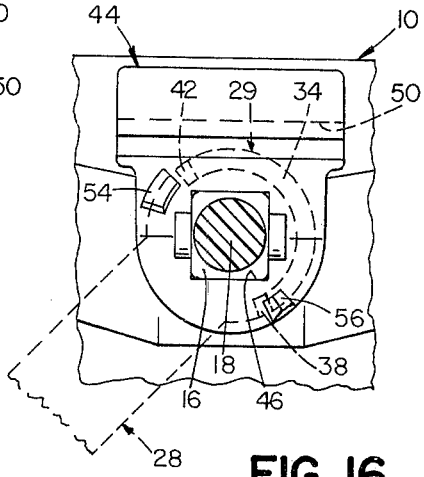
FIG 16
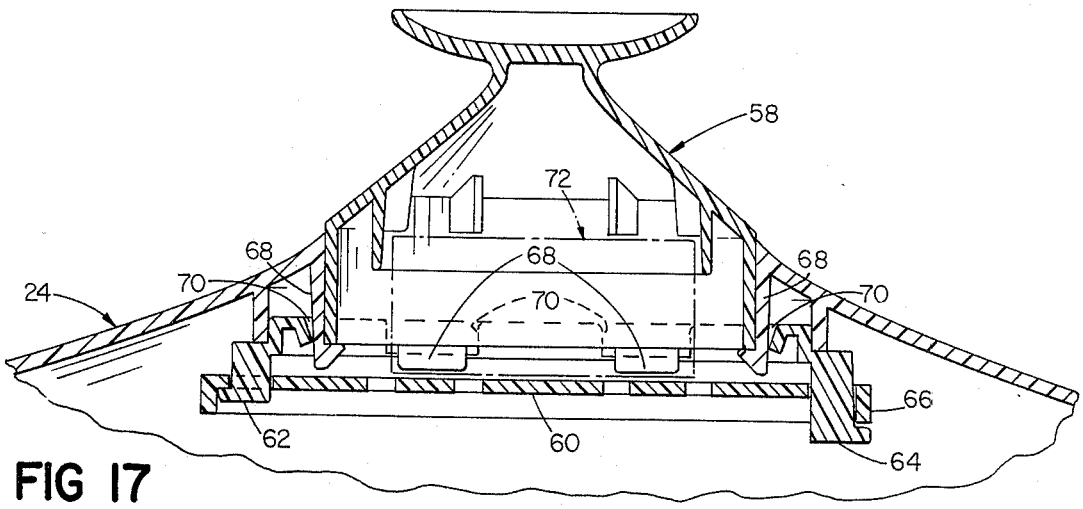
FIG 17

LATCHING RECEPTACLE LID

This invention relates to latching receptacle lids and more particularly to a novel latching arrangement for locking and unlocking a lid on a pail, such as a diaper pail.

It is a principal object of this invention to provide a latching arrangement for a receptacle having a bail which will lock the lid thereon with the bail in an upright position, as when being carried, and with the bail on one side of the receptacle and which will unlock the lid when the bail is on the other side of the receptacle. It is another object of this invention to provide a latching arrangement operable simply by movement of the bail. In preferred embodiments, further objects are to provide an arrangement in which the lid may be placed on the receptacle for locking in any rotative position relative to the receptacle and in which the lid may be placed on the receptacle even with the latching arrangement in a locked position.

In general the invention features a receptacle having an opening, a bail pivotally mounted on the receptacle for rotation from one side, over said opening, to the other side of the receptacle and a lid for covering the opening. Cooperating means are provided on the receptacle, the bail and the lid for locking the lid with the bail on one side of the receptable and thereover and for unlocking the lid with the bail on the other side of the receptacle.

In preferred embodiments, the portion of the cooperating means on the lid extends for engagement with the other portions of the cooperating means in any rotative position of the lid and the receptacle and preferably comprises a latching surface extending completely about the periphery of the lid. The cooperating means further comprises resilient means, preferably rsilient latch members mounted on the receptacle, for resiliently moving away from and for returning to a lid locking position to permit the lid to be placed on the receptacle in a locking position of such means. The cooperating means in addition to latching surfaces on the lid, and latch members on the receptacle also includes actuating means on the bail for moving the latch members toward and away from a position locking the lid.

Further, in preferred embodiments the lid latching surfaces face upwardly, the latch members have inwardly extending downwardly facing latching portions for engaging the lid latching surfaces, cam surfaces and cam follower means are provided on the bail and on the latch members for cooperation to move the latch portions between positions locking and unlocking the lid. The latch members comprise levers having a fulcrum at the pivotal connection of the bail to the receptacle. The cam followers each comprise outwardly extending protrusions on the latch members, one above the fulcrum and on one side of the pivotal connection of the bail and the other below the fulcrum and on the other side of the pivotal connection of the bail. The cam surfaces on each end of the bail comprise an inwardly facing semi-circular first cam surface interrupted by a second cam surface inwardly raised relative to the first cam surface, and extending between the ends of the first cam surface. The cam followers are positioned so that one cam follower engages the second cam surface while the other cam follower is adjacent the first cam surface, the cam surfaces positioned to engage the upper cam follower against the second cam surface with the bail on one side and over the receptacle, for moving the latch portion to engage the lid latching surfaces, and to engage the lower cam follower against the second cam surface with the bail on the other side of the pail, for moving the latch portion away from the lid latching surfaces. The bail and latch members are mounted on shafts extending from the receptacle sides, the shafts each having an inner, non-circular portion and an outer circular portion, the latch members having non-circular apertures and mounted on the non-circular portions and the bail having cirular apertures and mounted on the circular portions.

Other objects, features and advantages of this invention will be apparent to those skilled in the art from the following detailed description of a preferred embodiment thereof taken together with the accompanying drawings in which:

FIGS. 11–13 are fragmentary side elevations in section of the latching assembly in different operational positions;

FIGS. 14–16 are fragmentary, partly diagrammatic, front elevations of the latching assemblies, respectively corresponding to FIGS. 11–13, showing the relationship of the latch member cam followers to the cam surfaces, illustrated in phantom broken lines, on the bail; and FIG. 17 is an enlarged, fragmentary setional view of a deodorizer holder in the lid of the pail.

Figure 1:
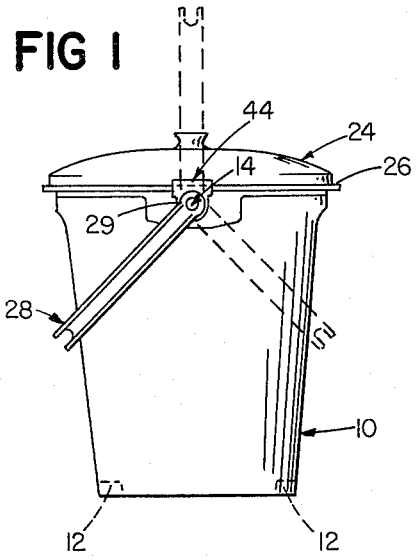
FIG. 1 is a side elevation of a pail embodying the invention.
Figure 2:
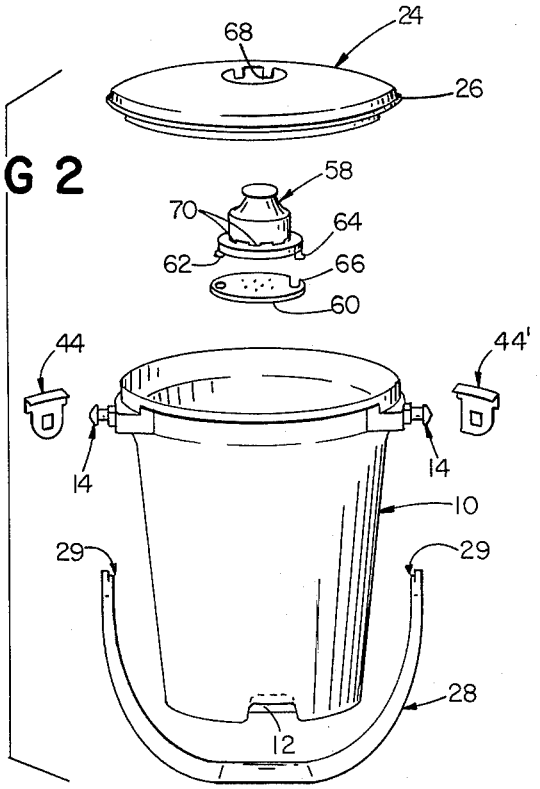
FIG. 2 is an exploded, front, isometric view of the pail.

A diaper pail 10, according to the invention, is illustrated in FIGS. 1 and 2. Pail 10 comprises a removable lid 24 for covering the open top of the pail, a bail 28 pivotally mounted on stub shafts 14 on either side of pail 10, bail 28 moveable from one side of the pail, thereover, to the other side thereof, and cooperating means on the lid, bail and pail for latching and unlatching the lid. In the preferred embodiment, the pail and lid are molded from high density polyethylene and the bail from glass reinforced styrene acrylonitrile for rigidity. Handholds 12 may optionally be provided in the pail base to faciltate tipping.

In the illustrated embodiment, FIGS. 1 and 2, the cooperating means on lid 24 comprises an upwardly facing lid latching surface 26 extending completely about the periphery of the lid 24. Lid 24 and pail 10 being circular, the lid 24 may be latched in any rotative position relative to pail 10 by virtue of the continuous surface 26 always providing lid latching surfaces adjacent bail ends 29.

Figure 5:
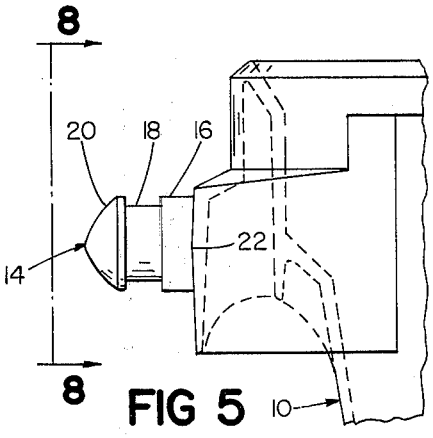
FIG. 5 is an enlarged, fragementary side elevation of a shaft on the side of the pail for receiving the bail end and latch member shown in FIGS. 3 and 4.
Figure 8:
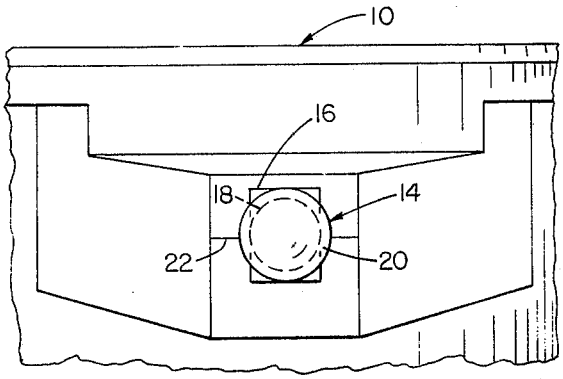
FIG. 8 is a view taken along the line 8—8 of FIG. 5.

Stub shafts 14, shown best in FIGS. 5 and 8, are integrally molded on the sides of pail 10 adjacent the upper edge thereof. Shafts 14 comprise an inner rectangular portion 16, an outwardly adjacent circular portion 18 and a head 20 enlarged relative to and outwardly adjacent circular portion 18.

Figure 3:
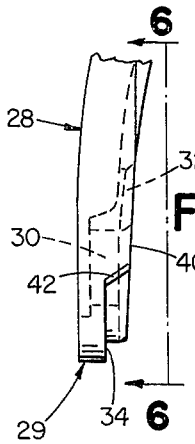
FIG. 3 is an enlarged, fragmentary side elevation of one end of the bail employed with the pail.
Figure 6:
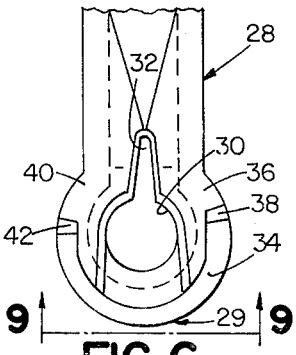
FIG. 6 is a view taken along the line 6—6 of FIG. 3.

The ends 29 of bail 28 have circular apertures 30, shown in FIGS. 3 and 6, for mounting on the circular portions 18 of shafts 14. A slot 32 extending upwardly from each bail aperture 30 facilitates placing the bail ends 29 over heads 20 on shafts 14. The cooperating means on bail 28 comprises actuating means in the nature of inwardly facing cam surfaces 34, 36, 40 on each end 29 of the bail 28. First cam surface 34 comprises a semi-circular inwardly facing surface formed about the lower periphery of the bail end 29 and coaxial of aperture 30. A second cam surface is formed in two parts by surfaces 36, 40 inwardly raised relative to surface 34 and extending between the ends thereof, being interrupted by slot 32. The ends of surface 34 are connected to surfaces 36, 40, respectively by sloping shoulders 38, 42. The arcuate extent of surface 34 between shoulders 38, 42 is preferably about 190° and each shoulder extends about 10° of arc.

Figure 4:
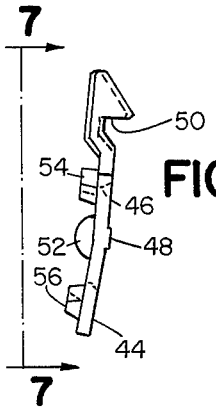
FIG. 4 is an enlarged side elevation of a latch member employed with the pail.
Figure 7:
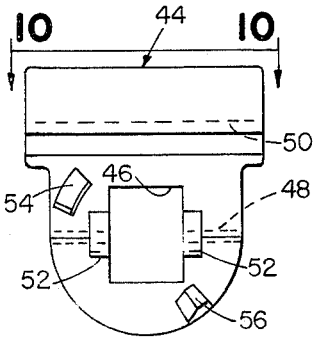
FIG. 7 is a view taken along the line 7—7 of FIG. 4.
Figure 10:
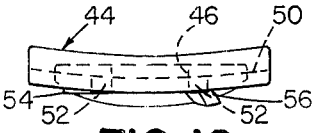
FIG. 10 is a view taken along the line 10—10 of FIG. 7.

The cooperating means on pail 10 comprises a latch member 44 mounted on each shaft 14 between pail 10 and bail 28. As shown in FIGS. 4 and 7, each latch member 44 has a rectangular aperture 46 for mounting on the rectangular portion 16 of shaft 14, the center of aperture 46 coaxial of the pivotal mounting of bail 28 on shaft 14. Latch member 44 comprises a lever having an inwardly extending downwardly facing hook or latch portion 50 at its upper end adapted to engage the upwardly facing lid latching surface 26. The mating surfaces of latch portion 50 and lid latching surface 26 are preferably formed at an angle of 15° downwardly in a direction extending inwardly from bail 28, to better resist lid removal from the pail with latch members in a latching position. As illustrated in FIG. 10, latch portion 50 has a concave configuration viewed from above. An inwardly facing flat portion 48 horizontally extending across latch member 44 centrally or aperture 46 defines the fulcrum of member 44 for positioning against pail 10. As illustrated in FIG. 4 the lower portion of member 44 is angularly offset outwardly below fulcrum 48.

On the outer side of member 44 to face cam surfaces 34, 36, 40, a pair of protrusions 54, 56 comprising cam followers are provided. An upper cam follower 54 is positioned above fulcrum 48 and on one side of aperture 46. A lower cam follower 56 is positioned below fulcrum 48 and on the other side of aperture 46. Cam followers 54, 56 are positioned on a radius from the center of aperture 46 a distance equal to the radius of cam surface 34 and are positioned with adjacent planar surfaces about 145° of arc apart. Horizontally spaced at fulcrum 48 on the opposite side of member 44 therefrom are a pair of semi-circular bail abutment members 52. Members 44 are made of glass reinforced styrene acrylonitrile and are resiliently deformable.

Figure 9:
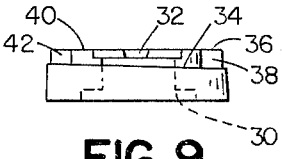
FIG. 9 is a view taken along the line 9—9 of FIG. 6.

When assembled, as best shown in FIGS. 11–13, each latch member 44 is mounted on shaft 14 with fulcrum 48 against a mold part line 22 on pail 10, angularly inwardly offset, see also FIG. 5. The flat fulcrum 48 avoids interference from any flash at the part line 22. Bail end 29 is mounted on shaft 14, retained thereon by shaft head 20, with the portion radially inwardly of surface 34 bearing against abutment members 52. One cam follower 54, 56 is engaged by second cam surface 36, 40 and the other cam follower is adjacent first cam surface 34, cam surfaces 34, 36, 40 being arranged so that the upper cam follower 54 bears against second cam surface 36, 40 with the bail 28 upright and on one side of pail 10, follower 56 then adjacent first cam surface 34, shown in FIGS. 12, 13, 15 and 16, and lower cam follower 56 bears against second cam surface 36, 40 and the bail on the other side of pail 10, follower 54 then adjacent first cam surface 34, shown in FIGS. 11 and 14. Since lower cam follower 56 is spaced further from fulcrum 48 than upper cam follower 54, lower cam follower 56 will move further than the upper cam follower 54 as latch member 44 is pivoted about fulcrum 48; to accommodate the greater motion of lower cam follower 56, first cam surface 34 is sloped, as shown in FIG. 9, downwardly on the side of cam surface 36 which will be positioned adjacent the lower cam follower 56 when the upper cam follower 54 is bearing against second cam surface 36, 40. Also, to accommodate the pivotal motion of latch member 44 about fulcrum 44, the vertical length of aperture 46 thereof, along a straight line, is slightly larger than the height of the rectangular portion 16 of shaft 14 on which the latch member 44 is mounted.

Also illustrated in FIGS. 2 and 17, but not comprising part of the present invention, is a deodorizer holder 58 for retention in lid 24. Holder 58 is designed to form a handle for the lid 24 and is inserted in a central aperture in the lid 24. Hooks 68 depend downwardly about the lid aperture and fit in slots 70 about a flange in the holder 58 to engage a shoulder thereof and to retain the holder in lid 24. A perforated cover 60 is swingingly mounted on support 62 integral with holder 58. On the opposite side of cover 60 a slot formed by structure 66 is adapted to engage support 64 also integral with holder 58. Thus a solid deodorizer 72 may be inserted and removed from holder 58 by opening and closing cover 60.

The operation of the latching mechanism may best be understood by reference to FIGS. 11–16. With the bail 28 on the side of pail 10 illustrated in FIGS. 11 and 14, the upper cam follower 54 faces first cam surface 34 and the lower cam follower 56 bears against the second, relatively inwardly extending, cam surface 36, 40 causing latch member 44 to pivot about fulcrum 48 to move latching portion 50 radially outwardly away from a locking position; hence lid 24 may be removed or placed on the pail. When the bail 28 is moved to an upright position over the pail, illustrated in FIGS. 12 and 15, or to the opposite side of the pail, illustrated in FIGS. 13 and 16, the lower cam follower 56 is positioned adjacent first cam surface 34 and the upper cam follower bears on the second cam surface 36, 40 pivoting latch member 44 to move latch portion 50 into a locking position for locking engagement with lid latching surface 26. As illustrated in FIG. 13, with the bail 28 on the side of pail 10 moving latch portion 50 into a locking position, lid 24 may nevertheless be placed on the pail by resiliently deforming the latch member 44.

It will be understood that the cam surfaces and cam followers on the bail and latch member are provided on each side of the pail and are arranged to actuate the latch portions on each side simultaneously for motion to and from locking positions thereof. To aid in identification of facing latch members one 44', as shown in FIG. 2 may have a squared portion while the other 44 is generally circular.

Advantageously, with the bail on one side of the pail in a position locking the lid thereon, access to the interior of the pail, including access to the deodorizer, is minimized to toddlers. Additionally with the bail upright, still locking the lid on the pail, the risk of spilliage of pail contents is minimized since the lid, secured on the pail, resists deformation of the pail when carried with a heavy load therein.

Other embodiments of this invention will occur to those skilled in the art which are within the scope of the following claims.

What is claimed is:

1. A receptacle having an opening, a bail pivotally mounted thereon for rotation from one side of said receptacle, over said opening and to the other side of said receptacle, a lid for covering said opening and cooperating means on said receptacle, said bail and said lid for locking said lid on said receptacle with said bail on one side and over said opening and for unlocking said lid with said bail on said other side, said means on said receptacle movable inwardly toward and outwardly away from said opening for respectively engaging and disengaging for locking and unlocking said means on said lid, and said means on said bail engaging said means on said receptacle and adapted to move said means on said receptacle inwardly for engagement with said means on said lid with said bail on said one side and over said opening and adapted to move said means on said receptacle outwardly for disengaging said means on said lid with said bail on said other side.

2. The receptacle claimed in claim 1 in which said lid is removable from said receptacle and in which said means on said lid extends on said lid for coaction with said means on said receptacle in any rotative position of said lid on said receptacle.

3. The receptacle claimed in claim 2 in which said means on said lid extends completely around the periphery of said lid.

4. The receptacle claimed in claim 1 in which said means on said receptacle comprises resilient means for locking said lid, said resilient means resiliently moveable away from a position adapted for locking said lid and for returning to said position, whereby said lid may be placed and locked on said receptacle with said resilient means in said position.

5. The receptacle claimed in claim 1 in which said cooperating means comprises latching surfaces on said lid, latch means on said receptacle adjacent said bail, said latch means moveable toward and away from a latching position for locking engagement of said lid latching surfaces, and actuating means on said bail for moving said latch means toward and away from said latching position.

6. The receptacle claimed in claim 5 in which said latch means comprises a pair of latch members one adjacent each end of said bail.

7. The receptacle claimed in claim 6 in which said latch members are of resilient material whereby said latch members in said latching position may be resiliently deformed for placing and locking said lid on said receptacle.

8. The receptacle claimed in claim 6 in which said lid is removable from said receptacle and in which said latching surfaces extend on the periphery of said lid for engagement by said latch members in any rotative position of said lid on said receptacle.

9. The receptacle claimed in claim 8 in which said latching surfaces comprise portions of a continuous surface extending completely about said periphery, said lid being circular.

10. The receptacle claimed in claim 9 in which said latch members are of resilient material whereby said latch members in said latching position may be resiliently deformed for placing and locking said lid on said receptacle.

11. The receptacle claimed in claim 10 in which said receptacle comprises a pail.

12. A receptacle having a lid for covering said receptacle, a bail pivotally connected at each end thereof on opposite sides of said receptacle and cooperating means for locking and unlocking said lid, said cooperating means comprising: upwardly facing lid latching surfaces on opposite sides of said lid for positioning adjacent said ends of said bail, a pair of latch members mounted on said receptacle, one adjacent each end of said bail, said latch members having downwardly facing inwardly extending cooperating latch portions for lockingly engaging said lid latching surfaces, and cam follower means and cam surfaces provided facing each other on said adjacent portions of said bail ends and said latch members for cooperation therewith to move said latch portions inwardly toward said lid latching surfaces for locking said lid with said bail on one side and over said receptacle and for moving said latch portions outwardly away from said lid latching surfaces for unlocking said lid with said bail on the other side of said receptacle.

13. The receptacle claimed in claim 12 in which said receptacle comprises a pail.

14. The receptacle claimed in claim 12 in which said latch members are resiliently moveable away from a position toward said lid latching surfaces.

15. The receptacle claimed in claim 12 in which said lid latching surfaces are positioned on and extend along the periphery of said lid for engagement by said latch members in any rotative position of said lid and said receptacle.

16. A receptacle having a lid for covering said receptacle, a bail pivotally connected at each end thereof on opposite sides of said receptacle and cooperating means for locking and unlocking said lid, said cooperating means comprising: upwardly facing lid latching surfaces on opposite sides of said lid for positioning adjacent said ends of said bail, a pair of latch members mounted on said receptacle, one adjacent each end of said bail, said latch members comprising levers having surfaces cooperating with surfaces on said receptacle to define fulcrums intermediate their vertically spaced ends and positioned at the pivotal connection of said bail to said receptacle, said latch members having downwardly facing inwardly extending latch portions positioned at the upper ends of said latch members for lockingly engaging said lid latching surfaces, said latch members pivotally moveable about said fulcrums for moving said latch portions toward and away from said lid latching surfaces, and cam follower means and cam surfaces provided facing each other on said adjacent portions of said bail ends and said latch members for cooperation therewith to move said latch portions inwardly toward said lid latching surfaces for locking said lid with said bail on one side and over said receptacle and for moving said latch portions outwardly away from said lid latching surfaces for unlocking said lid with said bail on the other side of said receptacle.

17. The receptacle claimed in claim 16 in which said cam surfaces are on said bail ends facing inwardly and said cam followers are on said latch members facing said cam surfaces, in which said cam followers on each latch member comprise an outwardly extending upper protrusion positioned above said fulcrum and to one side of said pivotal connection of said bail to said receptacle and another outwardly extending lower protrusion positioned below said fulcrum and on the opposite side of said pivotal connection of said bail to said receptacle and in which said cam surfaces on each end of said bail comprise an inwardly facing semi-circular first cam surface interrupted by a second cam surface inwardly raised, relative to said first cam surface, and extending between the ends of said first cam surface, one said cam follower engaging said second cam surface while said other said cam follower is adjacent said first cam surface, said cam surfaces positioned to engage the upper cam follower against said second cam surface with said bail on one side of and over said receptacle, for moving said latch portion toward said lid latching surfaces, and to engage the lower cam follower against said second cam surface with said bail on the other side of said receptacle, for moving said latch portion away from said lid latching surfaces.

18. The receptacle claimed in claim 17 in which said latch members are resiliently deformable away from a position toward said lid latching surfaces.

19. The receptacle claimed in claim 17 in which said lid latching surfaces are positioned on the periphery of said lid for engagement by said latch members in any relative position of said lid and said receptacle.

20. The receptacle claimed in claim 19 in which said lid is circular and said lid latching surfaces extend continuously about the periphery of said lid.

21. The receptacle claimed in claim 20 in which said latch members are resiliently deformable away from a position toward said lid latching surfaces.

22. The receptacle claimed in claim 21 in which shafts are provided on each side of said receptacle, said shafts each having an inner non-circular portion and thereadjacent an outer circular portion, and in which said latch members have non-circular apertures and are mounted on the non-circular portions of said shafts and said bail has circular apertures at each end thereof mounted on the circular portions of said shafts.

23. The receptacle claimed in claim 20 in which said receptacle comprises a pail.

* * * * *